United States Patent [19]

Kuo

[11] Patent Number: 4,836,532

[45] Date of Patent: Jun. 6, 1989

[54] ROWING EXERCISER

[76] Inventor: Hai P. Kuo, Che-Lu-Chien N.30, Pao-An-Tsun, Jen-Teh Hsiang, Tainan County, Taiwan

[21] Appl. No.: 937,791

[22] Filed: Dec. 4, 1986

[51] Int. Cl.[4] ..... A63B 69/06
[52] U.S. Cl. ..... 272/72
[58] Field of Search ..... 272/72, 130

[56] References Cited

U.S. PATENT DOCUMENTS

| | | | |
|---|---|---|---|
| 368,111 | 8/1887 | Reach | 272/72 |
| 4,488,719 | 12/1984 | Brown et al. | 272/72 |
| 4,621,623 | 11/1986 | Wang | 272/72 |
| 4,650,181 | 3/1987 | Yang | 272/72 |

FOREIGN PATENT DOCUMENTS

| | | | |
|---|---|---|---|
| 2511879 | 3/1982 | France | 272/72 |

*Primary Examiner*—V. Millin
*Assistant Examiner*—J. Welsh
*Attorney, Agent, or Firm*—Morton J. Rosenberg

[57] ABSTRACT

This invention relates to a rowing exerciser and in particular to one comprising a front rod, a rear rod, a frame connected across the front rod and the rear rod, a seat movably mounted in the frame, a pair of front connectors, a pair of rear connectors, a pair of hydraulic cylinders each having one end pivoted on a front connector, a pair of swivel arms each having one end pivoted on a rear connector, a pair of adjustable members each being provided at the middle of a swivel arm, and a pair of U-shaped blocks each pivoted on an adjustable member in one direction and rotatably connected with the other end of the swivel arm in another direction.

2 Claims, 4 Drawing Sheets

ROWING EXERCISER

BACKGROUND OF THE INVENTION

The importance of regular exercise is widely appreciated for reasons ranging from the need to control weight to programs for those recovering from heart ailments. Thus, various exercising devices have been developed to meet the need and the rowing exerciser is one of the most popular exercising device. However, the known exerciser is not satisfactory and should be improved.

With reference to FIG. 4, the prior art exerciser comprises a front rod 91, a rear rod 92, a frame 93 connected across the front rod 91 and the rear rod 92, a seat 94, a pair of hydraulic cylinders 95, a pair of swivel arms 96, and a pair of rotatable rod 97. The exerciser utilizes the swivel arms 96 to control the hydraulic cylinders 95 and the rotatable rods 97 to achieve the purpose of being capable of rotating through 360 degrees. The hydraulic cylinders 95 and the swivel arms 96 are fixed on the rotatable rods 97. The middle portion of the swivel arms 96 is connected to the shaft of the hydraulic cylinder 95. Thus, the exerciser can simulate the motion of rowing. However, such kind of exerciser is complicated in structure and costly in price.

It is, therefore, an object of the present invention to provide an improved rowing exerciser which may obviate and mitigate the above-mentioned drawbacks.

SUMMARY

This invention relates to an improved rowing exerciser.

The primary object of the present invention is to provide a rowing exerciser which can be moved in three dimensions.

Another object of the present invention is to provide a rowing exerciser which is inexpensive to produce.

Still another object of the present invention is to provide a rowing exerciser which is lightweight.

Still another object of the present invention is to provide a rowing exerciser which is easy to operate.

Still another object of the present invention is to provide a rowing exerciser which is simple in construction.

A further object of the present invention is to provide a rowing exceriser which is facile to manufacture.

The above and other objects and advantages of the present invention will appear more fully hereinafter from a consideration of the detailed description which follows taken together with the accompanying drawings wherein like numerals refer to like or similar parts and in which:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
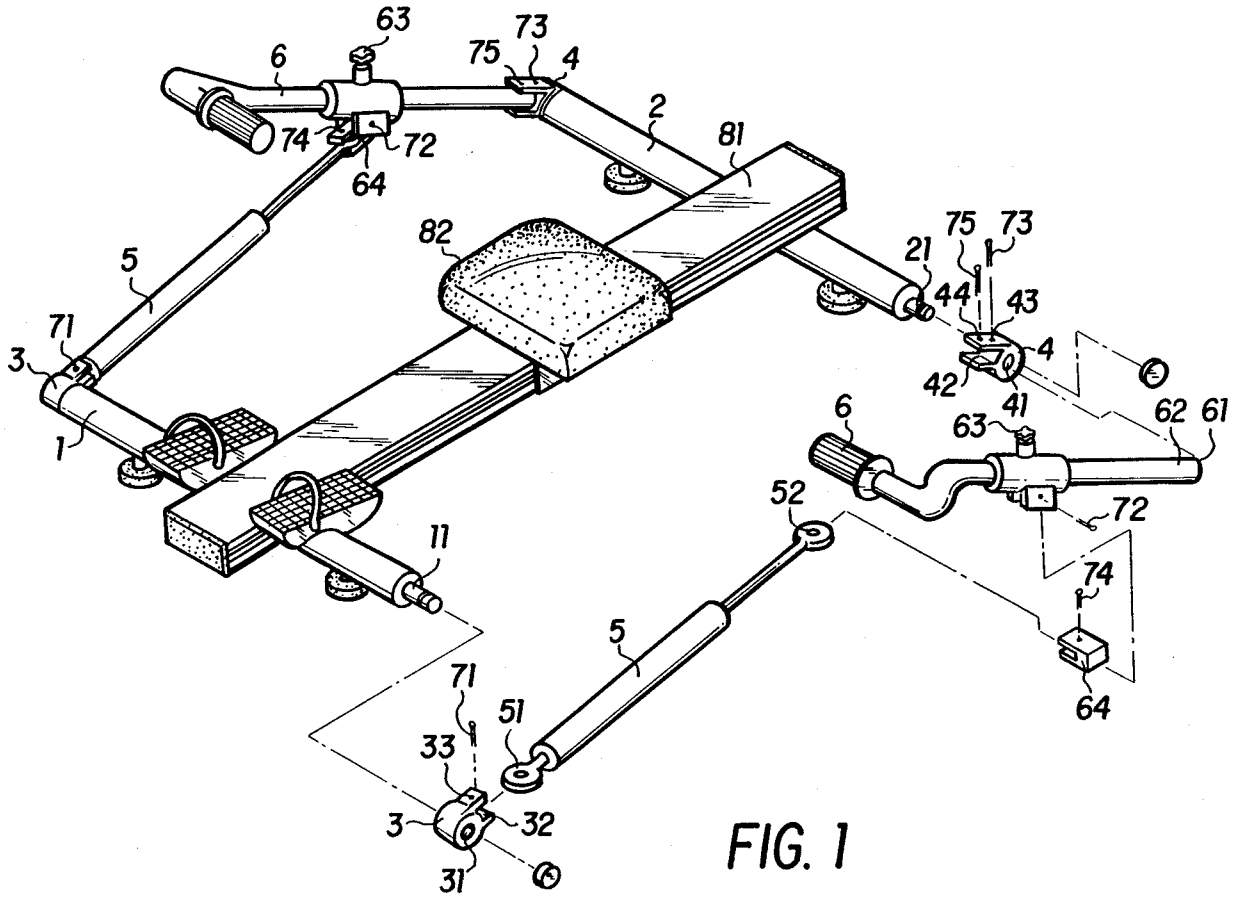
FIG. 1 is an exploded view of the present invention.
Figure 2:
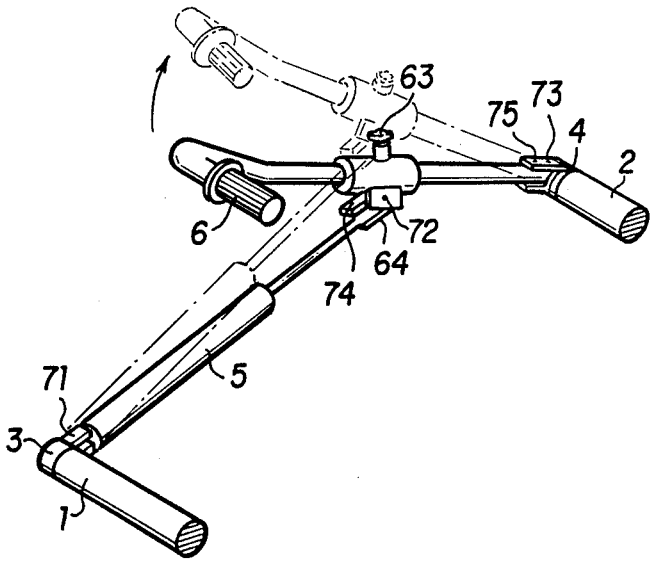
FIG. 2 shows how the present invention can be moved in plane YZ.
Figure 2A:
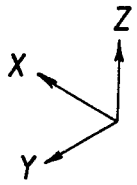
Figure 2A:
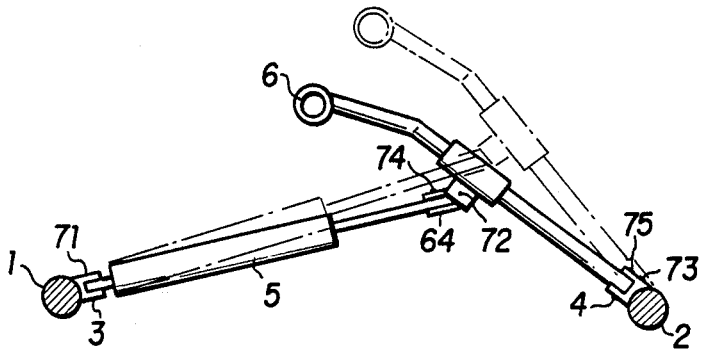
Figure 3:
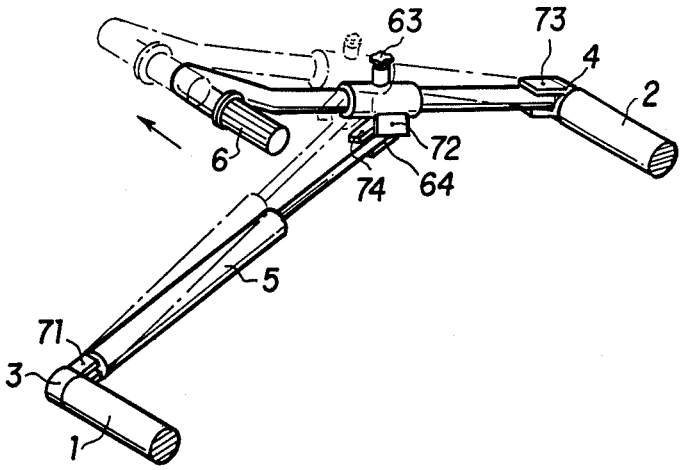
FIG. 3 shows how the present invention can be moved in plane XY.
Figure 3A:
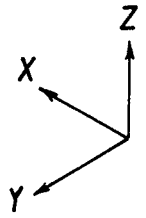
Figure 3A:
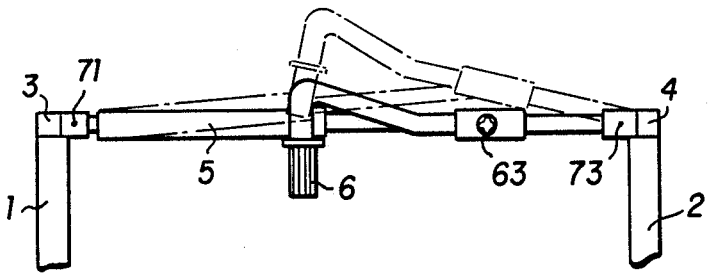

With reference now to the drawings and in particular to FIGS. 1 and 2 thereof, the rowing exceriser according to the present invention mainly comprises a front rod 1, a rear rod 2, a frame 81, a seat 82, a pair of swivel arms 6 and a pair of hydraulic cylinders 5. The frame 81 is mounted across the front rod 1 and the rear rod 2. The seat 82 is movably mounted on the frame 81. The front rod 1 is provided with a protuberance 11 at both ends while the rear rod 2 has a protuberance 21 at both ends. The protuberance 11 and the protuberance 21 are respectively provided with a connector 3 and a connector 4. The connectors 3 and 4 are formed with pin holes 31 and 41 respectively. The connector 3 has two lugs separated by a slot 32. As the connector 3, the connector 4 is provided with a slot 42 defined by two lugs. The lug of the connector 4 has a pin hole 43 and a fixing hole 44.

The hydraulic cylinder 5 has one end 51 pivoted to the slot 32 of the connector 3 by a pin 71. The swivel arm 6 is provided with two pin holes 61 and 62 at its one end. At the middle portion of the swivel arm 6 there is an adjustable member 63. A U-shaped block 64 is pivotally connected to the adjustable member 63 by fixing a pin 72. The end of the swivel arm 6 is received in the slot 42 of the connector 4 and fixed thereto by a pin 73 extending through the pin hole 43 and 61. The other end 52 of the hydraulic cylinder 5 is pivotally connected to the U-shaped member 64 by a pin 74.

Looking now at FIGS. 1 and 2, when the connectors 3 and 4 are rotated about the protuberance 11 of the front rod 1 and the protuberance 21 of the rear rod 2 and the U-shaped block 64 is rotated about the fixing pin 72, the swivel arms and the hydraulic cylinders 5 will move in the same plane, e.g. in YZ plane. That is, the swivel arm 6 can be moved rearwards by pulling out the shaft of the hydraulic cylinder 5. On the other hand, as the swivel arm 6 and the hydraulic cylinder 5 are rotated respectively about the fixing pin 73 and the fixing pins 71 and 74, the swivel arm 6 and the hydraulic cylinder 5 can move along plane XY. Consequently, the swivel arm 6 can be moved in three dimensions thereby being capable of simulating the actual rowing motion.

When desired to enable the swivel arm 6 to move in plane YZ only, it is only necessary to insert a pin 75 through the hole 44 of the connector 4. Since the pins 75 and 73 are respectively inserted into the holes 61 and 62 of the swivel arm 6 at the same time, the swivel arm 6 can only be moved in plane YZ and cannot move in plane XY.

Figure 4:
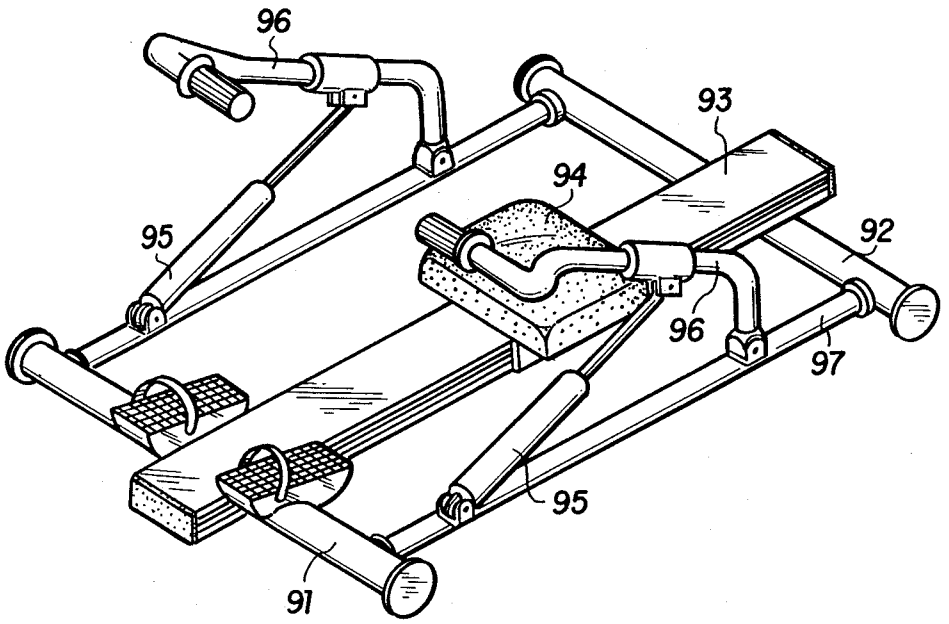
FIG. 4 PRIOR ART
FIG. 4 is a prior art rowing exerciser.

The prior art rowing exerciser (as shown FIG. 4) makes use of two rotatable rods 97 mounted between the front rod 91 and the rear rod 92 to enable the swivel arm 96 to simulate the rowing motion, while the present invention utilizes only the combination of the connectors 3 and 4 and the U-shaped block 64 to achieve the same purpose. Hence, the present invention does not need the rotatable rods thereby reducing the manufacturing cost and decreasing the weight thereof.

From the foregoing, it will be observed that numerous variations and modifications may be effected without departing from the true spirit and scope of the novel concept of the present invention. It will be understood that no limitations with respect to the specified article illustrated herein is intended to cover by the appended claims all such modifications as fall within the scope of the claims.

I claim:

1. A rowing exerciser comprising:

a front rod having a protuberance at each end thereof;

a rear rod having a protuberance at each end thereof;

a frame connected across the front rod and the rear rod;

a seat movably mounted on the frame a pair of front connectors each having two lugs separated by a slot, each said front connector being rotatably connected respectively with one of said protuberance of the front rod;

a pair of rear connectors each having two lugs separated by a slot, each said rear connector being rotatably connected respectively with one of said protuberance of the rear rod;

a pair of hydraulic cylinders each having one end pivoted on a front connector;

a pair of swivel arms each having one end pivoted on a rear connector;

a pair of adjustable members each being provided at the middle of a swivel arm;

a pair of U-shaped blocks each pivoted respectively on one of said adjustable member in one direction and rotatably connected with the other end of the swivel arm in another direction;

whereby the swivel arms can be easily moved in three dimensions.

2. A rowing exerciser as claimed in claim 1, wherein each rear connector is provided with two holes so that the swivel arms can be moved in three dimensions when only one pin is inserted through a corresponding hole of the rear connector and that the swivel arms can be moved in only two dimensions when two pins are inserted through the two holes of the rear connector.

* * * * *